US005554469A

United States Patent [19]

Larson et al.

[11] Patent Number: 5,554,469

[45] Date of Patent: Sep. 10, 1996

[54] CHARGING PROCESSES WITH LIQUID COMPOSITIONS

[75] Inventors: James R. Larson, Fairport; John S. Facci; Martin A. Abkowitz, both of Webster; Joseph Mammino, Penfield; Milan Stolka, Fairport; John W. Spiewak, Webster, all of N.Y.

[73] Assignee: Xerox Corporation, Stamford, Conn.

[21] Appl. No.: 566,265

[22] Filed: Dec. 1, 1995

[51] Int. Cl.[6] ..... G03G 13/02

[52] U.S. Cl. ..... 430/31; 430/902; 355/219; 361/225

[58] Field of Search ..... 430/31, 902; 355/219; 361/225

[56] References Cited

U.S. PATENT DOCUMENTS

| | | | |
|---|---|---|---|
| H1483 | 9/1995 | Larson et al. | 430/115 |
| 2,904,431 | 8/1954 | Moncrieff-Yates . | |
| 2,987,660 | 6/1955 | Walkup . | |
| 3,394,002 | 10/1964 | Bickmore . | |
| 4,086,650 | 4/1978 | Davis et al. | 361/229 |
| 4,585,320 | 4/1986 | Altavela et al. | 361/212 |
| 5,366,840 | 11/1994 | Larson et al. | 430/115 |
| 5,457,523 | 10/1995 | Facci et al. | 355/219 |
| 5,510,879 | 4/1996 | Facci et al. | 361/225 X |

OTHER PUBLICATIONS

"Current Problems in Electrophotography", R. B. Lewis, H. M. Shark, 1972, p. 328.

Photographic Science and Engineering, vol. 15, No. 4, Jul.–Aug. 1971, "Characteristics of Corona Discharge and Their Application to Electrophoto–graphy", M. M. Shahin, pp. 322–328.

*Primary Examiner*—Roland Martin

*Attorney, Agent, or Firm*—E. O. Palozzo

[57] ABSTRACT

A process for changing layered imaging members by the transfer of ions thereto which comprises contacting the imaging member with a liquid developer comprised of a nonpolar liquid, and a mixture of surfactants of an ammonium block copolymer first surfactant of the formula wherein $X^-$ is a conjugate base or anion of a strong acid; R is hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 1,000 to 200; and a second surfactant component of the formula wherein $R_1$ is selected from the group consisting of hydrogen and alkyl, and n is 0 (zero), 1, 2, 3, or 4.

31 Claims, 3 Drawing Sheets

CHARGING PROCESSES WITH LIQUID COMPOSITIONS

BACKGROUND OF THE INVENTION

This invention is generally directed to processes for charging imaging members, such as photoreceptors, photoconductive imaging members and dielectric charge receivers, for ionography. More specifically, in embodiments the present invention relates to processes for charging photoconductive imaging members, especially and preferably layered imaging members by ionic conduction and wherein, for example, corona charging and discharging devices together with their known disadvantages can be avoided and/or minimized. Embodiments of the present invention include a process for the ion transfer charging of photoconductive imaging members, which process comprises contacting a liquid developer, or liquid developer fluid with the surface of the imaging member; and applying a voltage while moving, such as rotating the imaging member, thereby enabling the transfer of ions, preferably of a single sign, such as positive or negative, from the liquid/imaging member interface to the imaging member. The developer selected in embodiments contains mixed surfactants that, for example, increase the conductivity of the liquid developer by orders of magnitude relative to unmixed surfactant developer containing solutions, and wherein there is promoted ion transfer charging at high process speeds and with lower surfactant loading. Examples of developers selected include those containing mixed surfactants or charge directors of polymeric ammonium HBr salts, preferably poly[H,N-dimethyl-N-ethyl methacrylate ammonium bromide (A block)-co-2-ethylhexyl methacrylate (B block)] and salicylic aluminate, and more specifically, hydroxybis[3,5-di-t-butyl salicylic aluminate monohydrate] (ALOHAS), include those as illustrated in U.S. Pat. No. 5,366,840 and U.S. Ser. No. 065,414, now U.S. Statutory Invention Registration H1483, the disclosures of which are totally incorporated herein by reference. For example, a liquid developer with an 80/20 mixture of poly[N,N-dimethyl-N-ethylmethacrylate ammonium bromide (A block)-co-2-ethylhexyl methacrylate (B block)] and ALOHAS enables a charging fluid conductivity of about 100 times greater than the same concentration of the individual components. More specifically, charge directors include AB diblock, ABA triblock, BAB triblock copolymers or mixtures thereof with a $M_w$ of from, for example, about 2,000 to about 250,000, and wherein, for example, the A blocks are comprised of the repeat units of N,N-dimethyl-ammonium-N-ethyl methacrylate bromide sale, and the B block is comprised of repeat units of 2-ethylhexyl methacrylate, reference the block copolymer poly[N,N-dimethyl-N-ethylmethacrylate ammonium bromide (A Block)-co-2-ethylhexyl methacrylate (B Block)]. The diblock ammonium bromide copolymers are illustrated in U.S. Ser. No. 065,414, now U.S. Statutory Invention Registration H1483; the ABA triblocks in copending application U.S. Ser. No. 231,086 now U.S. Pat. No. 5,484,679; and the BAB triblocks in copending application U.S. Ser. No. 519,265, pending the disclosures of which are totally incorporated herein by reference. Also, in embodiments the liquid charging fluid is essentially free of thermoplastic resin and pigment.

The charging of photoconductive imaging members by means of corona discharge methods is known, however, a number of disadvantages are associated with these methods, such as the generation of ozone, the use of high voltages, such as from about 6,000 to about 7,000 volts, which requires the use of special insulation, maintenance of the corotron wires at added costs, low charging efficiency, the need for erase lamps and lamp shields, and the like. Since it can be a health hazard in some instances, ozone is removed by passage through a filter. Corona charging generates oxides of nitrogen which desorb eventually from the corotron surfaces and eventually oxidize the transport molecule thereby adversely effecting the electrical properties of the photoreceptor. These can show up as print deletions.

Generally, the process of electrostatographic copying is initiated by placing a substantially uniform electrostatic charge on a photoreceptive member. Subsequent to this charging, imaging is accomplished by exposing a light image of an original document onto the substantially uniformly charged photoreceptive member. Exposing the charged photoreceptive member to a light image discharges the photoconductive surface thereon in areas corresponding to nonimage areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate for creating a visible image, which may be permanently affixed to the image support substrate, thereby providing a reproduction of the original document. In a final step in the process, the photoconductive surface of the photoreceptive member can be cleaned to remove any residual developing material which may be remaining on the surface thereof in preparation for successive imaging cycles.

Liquid developers are generally known including developers with the charge directors mentioned herein.

The electrostatographic copying process described herein is well known and is commonly used for light lens copying of an original document. Analogous processes also exist in other electrostatographic printing applications such as, for example, digital laser printing where a latent image is formed on the photoconductive surface via a modulated laser beam, or ionographic printing, and reproduction where charge is deposited on a charge retentive surface in response to electronically generated or stored images.

In addition to charging the imaging surface of an electrostatographic system prior to exposure, corona devices are used to perform a variety of other functions in the electrostatographic process. For example, corona generating devices aid in the transfer of an electrostatic toner image from a reusable photoconductive imaging member to a transfer member such as paper; the tacking and detacking of the transfer member to and from the imaging member; and the conditioning of the surface of the imaging member prior to, during, and after deposition of toner thereon to improve the quality of the electrostatographic copy produced thereby. Each of these functions can be accomplished by a separate and independent corona generating device. The relatively large number of devices within a single machine necessitates the economical use of corona generating devices.

Various types of charging devices have been used to charge or precharge the surface of a photoconductive member. Corona generating devices are used extensively, wherein a voltage of 2,000 to 10,000 volts may be applied across an electrode to produce a corona spray which imparts electrostatic charge to a surface situated in close proximity thereto. One particular corona generating device includes a single corona generating electrode strung between insulating end blocks mounted on either end of a channel formed by a U-shaped shield or a pair of spaced side shield members. The corona generating electrode is typically a highly conductive, elongated wire positioned opposite the surface to be charged. In other conventional corona generating devices, the corona generating electrode may also be in the form of a pin array. Another device, frequently selected to provide for a more uniform charging and to prevent overcharging includes two or more corona generating electrodes with a control grid comprising a screen having a plurality of parallel wires or a plate having multiple apertures positioned between the corona generating electrodes and the photoconductive member. In this device, a potential having the same polarity as that applied to the corona electrodes but having a much smaller voltage magnitude, usually about a few hundred volts, is applied to the control grid to suppress the electric field between the control grid and the corona electrodes, markedly reducing the ion current flow to the photoconductive member.

Yet another type of corona generating device is described in U.S. Pat. No. 4,086,650 wherein a corona discharge electrode is coated with a relatively thick dielectric material, such as glass, for substantially preventing the flow of conduction current therethrough. In this device, the delivery of charge to the photoconductive member is accomplished by a displacement current or by capacitive coupling through the dielectric material. The flow of ions to the surface to be charged is regulated by means of a DC bias applied to the shield of the corona generating device. In operation, an AC potential of approximately 5,000 to 7,000 volts is applied to the coated electrode at a frequency of about 4 KHz to produce an actual corona generating current of approximately 1 to 2 milliamperes. This device has the advantage of providing a uniform charge to the photoconductive member using a charge generating device that is highly insensitive to contamination by dirt and, therefore, does not require repetitive cleaning or other maintenance requirements.

One problem associated with corona generating devices occurs in the presence of the generated corona, wherein a region of high chemical reactivity is also produced such that new chemical compounds may be synthesized. This chemical reactivity correspondingly causes a build up of chemical growth on the corona generating electrode as well as other surfaces adjacent thereto. After a prolonged period of operation, these chemical growths may degrade the performance of the corona generating device and also the entire electrostatographic machine.

Free oxygen, ozone, and other corona effluents, such as nitrogen oxide and nitrogen oxide species, can be produced in the corona region. These nitrogen oxide species react with solid surfaces. In particular, it has been observed that, in some instances, these nitrogen oxide species are adsorbed by the conductive control grid, the shield, shield members and other components of the corona generating device. The adsorption of nitrogen oxide species occurs even though the corona generating device may be provided with a directed air flow during operation for removing the nitrogen oxide species as well as controlling ozone emissions. During the process of collecting ozone, directed air flow may exacerbate problems by carrying the nitrogen oxide species to an affected area of the corona generating device or even to some other machine part.

The reaction of corona generating process byproducts, such as nitrogen oxide, with the shield, the control grid, or other corona generating device components can result in corrosive buildup and deposition on the surfaces thereof. These deposits can cause problems, such as nonuniform photoreceptor charging, manifested by side-to-side density variations, or dark and light streaks in an output copy. Also, depending on environmental conditions, deposits may charge up and effectively increase the shield or screen voltage resulting in similar nonuniformity defects. Extreme cases of corrosion can lead to arcing between the corona generating electrode and the screen on the shield members.

Another problem associated with corona generating devices operating in an electrostatographic environment results from toner accumulation on the surface of the corona generating electrode as well as surfaces adjacent thereto. The spots of accumulated toner, being a dielectric in nature, tend to cause localized charge buildup on the interior surfaces of the shield which produces current nonuniformity and reduction in corona current. Localized toner accumulations on the insulating end blocks which support the wire electrode also cause sparking.

Moreover, adsorption can be a physically reversible process such that the adsorbed nitrogen oxide species are gradually desorbed when a machine is turned off for an extended period of idleness. The adsorbed and desorbed species are both nitrogenous but not necessarily the same, that is there may be a conversion of $NO_2$ to $HNO_3$. When the operation of the machine is resumed, a copy quality defect, commonly referred to as a parking deletion, can result wherein a line image deletion or a lower density image is formed across the width of the photoreceptor at that portion of its surface resting opposite the corona generating device during the period of idleness. It is believed that the nitrogen oxide species interact with the surface of the photoreceptor to increase the lateral conductivity thereof such that the photoreceptor cannot effectively retain a charge in image configuration. This phenomenon basically causes narrow line images to blur or to wash out so as to not be developed as a toner image.

In corona generating devices, it has been found that the material from which the components, such as the shield or control grid, are fabricated has an effect on the severity of parking deletions. In the prior art, stainless steel materials have commonly been used as shields. Other materials, such as corrosion resistant ferrous materials which prevent the rapid oxidation of the component material and the concurrent loss of performance of the corona generator, have met with limited success, primarily due to the corrosive effect of the corona produced by the device.

In other attempts to reduce the problems associated with corona charging, considerable effort has been accomplished to reduce the adsorption of nitrogen oxides species by device components via the application of electrodag coatings to the surfaces thereof. These coatings typically include a reactive metal base such as nickel, lead, copper, zinc or mixtures thereof. These reactive metal base materials tend to absorb, or form harmless compounds with the nitrogen oxide species. However, parking deletion problems have continued, in some instances, due, for example, to the failure of the electrodag materials to continue to absorb or form harmless compounds with the nitrogen oxide species over time. In addition, certain components needed to address this problem are costly to fabricate.

Thus, the problem of chemical growth buildup in and around corona generating devices has been addressed by providing coating materials that are less prone to chemical attack. While adequately addressing the problem, such materials have substantially increased the cost of corona generating devices. Various forms of corona generating devices have been described for use in electrostatographic reproduction machines.

U.S. Pat. No. 4,258,258 discloses a corona generating device having a corona generating electrode supported between a pair of end block assemblies. Each end block assembly defines a space for the passage of the electrode, and nonconductive inserts for surrounding the electrodes that are seated in the spaces of the end block assemblies. The nonconductive inserts are made from a high dielectric strength material that is also resistant to a corrosive atmosphere. The inserts are easily and inexpensively replaced so as to protect the end block assemblies from the effects of high voltage applied to the corona electrode. Also mentioned with respect to corona generating devices are U.S. Pat. Nos. 4,585,320; 4,585,322 and 4,585,323. Also of interest are U.S. Pat. No. 2,987,660, see for example column 2, lines 50 to 68, column 3, lines 49 to 70, and specifically column 3, lines 59 to 61, wherein water is mentioned as a conductive liquid; U.S. Pat. Nos. 3,394,002; and 2,904,431.

Generally, layered photoresponsive imaging members are described in a number of U.S. patents, such as U.S. Pat. No. 4,265,900, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Moreover, there are disclosed in U.S. Pat. No. 4,419,427 electrographic recording mediums with a photosemiconductive double layer comprised of a first layer containing charge carrier perylene diimide dyes, and a second layer with one or more compounds which are charge transporting materials when exposed to light, reference the disclosure in column 2, beginning at line 20.

Illustrated in copending patent application U.S. Ser. No. 332,313, pending the disclosure of which is totally incorporated herein by reference, is a process for charging layered imaging members by the transfer of ions thereto from an ionically conductive medium, wherein the ionically conductive medium is comprised of a liquid or a gel such as a hydrogel of a polyacrylate, polyacrylamide, polyvinylether, polypyrrolidinone, or polyhydroxyethylmethacrylate.

Illustrated in now U.S. Pat. No. 5,485,253, the disclosure of which is totally incorporated herein by reference, is a corona generating device and, more particularly, a reusable corona charging apparatus for use in an electrostatographic printing machine to generate a flow of ions onto an adjacent imaging surface so as to alter the electrostatic charge thereon.

In U.S. Ser. No. 065,414, now U.S. Statutory Invention Registration H1483; U.S. Pat. No. 5,306,591 and U.S. Pat. No. 5,308,731, the disclosures of which are totally incorporated herein by reference, there is illustrated a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof.

The disclosures of each of the above patents and patent applications are totally incorporated herein by reference.

Illustrated in now U.S. Pat. No. 5,510,879, the disclosure of which is totally incorporated herein by reference, is a process for charging layered imaging members by the transfer of ions thereto from an ionically conductive medium.

DESCRIPTION OF FIGURES

FIG. 3 illustrates the theoretically calculated currents for the charging of an insulative substrate, and wherein the current is plotted against the applied voltages; and FIGS. 4 and 5 are as indicated hereinafter.

SUMMARY OF THE INVENTION

Figure 1:
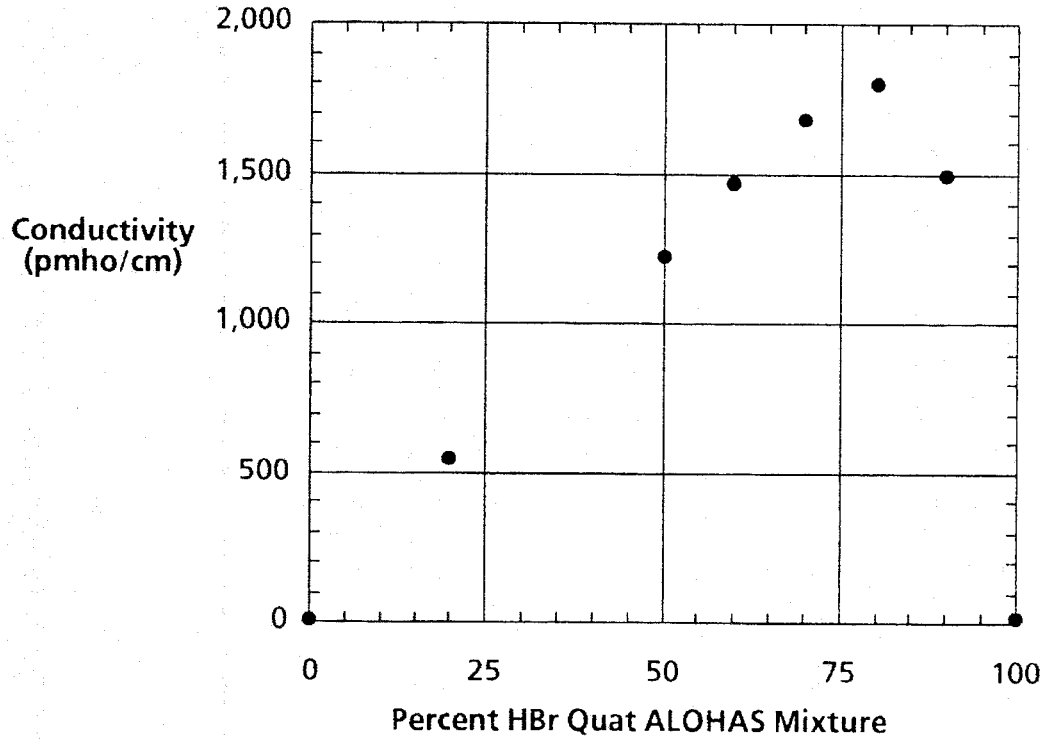
FIGS. 1 to 5 represent graphs wherein the conductivity versus the weight percent of a mixture of HBr quat salt and ALOHAS is illustrated in FIG. 1; an ion charging relationship is illustrated in FIG. 2 wherein the surface voltage of an imaging member or substrate is plotted against the applied voltage.

Examples of objects of the present invention include:

It is an object feature of the present invention to provide processes for imaging member charging or the charging of other components or surfaces like ionographic members with many of the advantages illustrated herein.

It is yet another object of the present invention to provide processes for the charging of layered imaging members with liquid developers.

Another object of the present invention relates to the ion transfer charging of photoreceptors.

Moreover, in another object of the present invention there are provided processes wherein corona charging devices for the charging of layered photoconductive imaging members can be eliminated.

Additionally, in another object of the present invention ionically conductive liquids are selected for the charging of photoconductors, including layered photoconductive imaging members comprised of a photogenerating layer and a charge transport layer, reference for example U.S. Pat. No. 4,265,990.

Also, in another object of the present invention, conductive liquid developers with a mixture of surfactants are selected for the charging of photoconductors, including layered photoconductive imaging members comprised of a photogenerating layer and a charge transport layer, reference for example U.S. Pat. No. 4,265,990, and wherein the mechanism of charging is the transfer of ions to the imaging member; and wherein a mixture of surfactants enables an increase in the conductivity of liquid developers.

A further object of the present invention resides in the provision of processes for charging imaging members by the transfer of ions thereto, and which members can be selected for a number of imaging processes including xerographic imaging and printing methods, such as full color, highlight color, trilevel color processes, and ionographic imaging methods.

These and other objects of the present invention can be accomplished in embodiments thereof by the provision of processes for the charging of imaging members. In embodiments, the process of the present invention comprises the charging of photoreceptors by the transfer of ions thereto. More specifically, in embodiments the process of the present invention comprises the ionic transfer charging of photoconductive imaging members, which process comprises contacting a liquid developer with a nonpolar liquid hydrocarbon, and an important mixture of surfactants, with the surface of the imaging member; and applying a voltage to the developer while rotating or translating the imaging member thereby enabling the transfer of ions of a single sign, such as positive or negative polarity, from the liquid/imaging member interface to the imaging member. The photoreceptor thus becomes charged by the voltage applied to the liquid developer in contrast to applying a voltage directly to the photoreceptor by a corotron. In embodiments, a grounded liquid developer contact may be applied to remove charge from the surface.

Embodiments of the present invention include an ozone free process for the ion transfer charging of photoconductive imaging members which comprises contacting a liquid developer with mixed surfactant with the surface of a photoconductive imaging member, and applying a voltage to the developer while moving the imaging member thereby enabling the transfer of ions to the member; and also wherein movement is by rotation at high speeds of from about 0.1 inch to about 50 inches per second of said imaging member; wherein the voltage applied is from about ±1 volts to about ±5,000 volts; wherein the voltage applied is from about ±50 volts to about ±1,000 volts, and preferably from about ±300 volts to about ±750 volt. Also, in embodiments the contacting is for a period of time of from about 1 millisecond to about 15 seconds; wherein the contacting is for a period of time of from about 5 milliseconds to about 1 second; wherein the liquid developer is delivered to the imaging member by a sponge, an open cell foam, a roll, a blade and/or a wick; wherein the diblock B:A molar ratio is from about 0.1:99.9 to about 99.9:0.1; wherein charging of an ionographic receiver is accomplished; and wherein there can be selected ABA, or BAB copolymers as the first surfactant.

Specific embodiments of the present invention are directed to a process for charging layered photoreceptors by the transfer of ions thereto from a liquid fluid or developer comprised of a liquid component, and a mixture of a surfactant (charge director) comprised of an ammonium AB diblock copolymer first surfactant of the formula

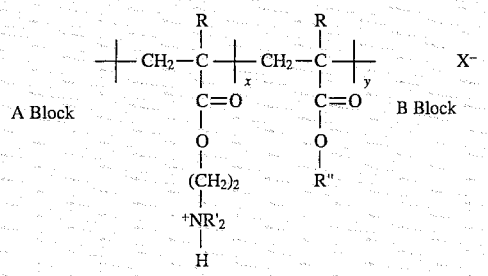

wherein $X^-$ is a conjugate base or anion of a strong or concentrated acid like sulfuric acid; R is hydrogen or alkyl with, for example, from 1 to about 25 carbon atoms; R' is alkyl with, for example, from 1 to about 25 carbon atoms; R" is an alkyl group containing from about 6 to about 20 carbon atoms; and y and x represent the number average degree of polymerization (DP) wherein the ratio of y to x is preferably in the range of from about 10 to 2 to about 1,000 to 200, or 100 to 20, or the B:A molar ratio is from about 0.1:99.9 to about 99.9:0.1 in the polymeric ammonium salt surfactant; and a second surfactant charge additive or adjuvant comprised of an aluminum hydroxy carboxylic acid component of the formulas

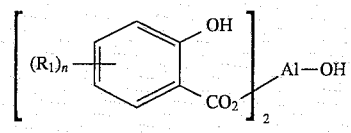

or

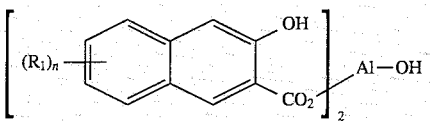

wherein $R_1$ is selected from the group consisting of hydrogen and alkyl, and n is 0 (zero), 1, 2, 3, or 4. In embodiments, a number of ammonium AB diblocks can be selected in a variety of mole ratios, and when mixed with an aluminum hydroxy carboxylic acid adjuvant enables a hydrocarbon soluble ionized charging fluid. The BA molar ratio can range from 0.1:99.9 to 99.9:0.1.

Present in the liquid developer is a mixture of the surfactants indicated herein, and wherein the mixture contains from about 5 to about 95 weight percent of the first polymeric ammonium HBr salt component surfactant and from about 95 to 5 weight percent of the second aluminum hydroxy-carboxylic acid charge additive or adjuvant component, and preferably from about 70 to about 85 weight percent of the first polymeric ammonium HBr salt component surfactant and from about 30 to about 15 weight percent of the ALOHAS (aluminum hydroxy carboxylic acid) component. With the preferred mixture, the conductivity of the liquid developer is greater than about 1,500 pmho/centimeter.

FIG. 1 illustrates the relationship between the low field conductivity and the amount of a mixture of poly[N,N-dimethyl-N-ethyl methacrylate ammonium bromide (A block)-co-2-ethylhexyl methacrylate (B block)] salt (HBr Quat) and hydroxy bis[3,5-di-t-butyl salicylic] aluminate monohydrate (ALOHAS) wherein the total weight of the solids in solution is fixed at 0.1 weight percent in NORPAR 15®. The conductivity of the fluid is dramatically enhanced by mixing the polymeric ammonium HBr salt surfactant with the salicylic aluminate adjuvant. The optimum conductivity of NORPAR 15® containing a total of 0.1 weight percent of the aforementioned surfactant and adjuvant is obtained when 80 percent of the solids is comprised of polymeric ammonium HBr salt poly[N,N-dimethyl-N-ethyl methacrylate ammonium bromide (A block)-co-2 ethyl hexyl methacrylate (B block)], and 20 percent is the salicylic aluminate as hydroxy bis[3,5-di-t-butyl salicylic] aluminate monohydrate shown in FIG. 1. The preferred conductivity range is greater than 100 pmho/centimeter, and for example, from about 500 to about 1,700 pmho/centimeter.

Several elements are involved in the process of ion transfer charging. An ionically conductive liquid is electrified to a given voltage. The electrified liquid is contacted against an insulative substrate coated onto a ground plane. Finally, the insulative ground plane is moved past the liquid contact.

One of the advantageous characteristics of ion transfer charging is that its efficiency approaches 100 percent. For example, if a voltage of about 750 volts is applied to the liquid, a slightly lower voltage, such as about 725 volts to 749 volts, is typically developed on the surface of the insulative substrate or on the surface of the imaging member. This would represent a voltage efficiency of greater than 97 percent. A typical charging curve for ion transfer charging is shown in FIG. 2.

Figure 2:
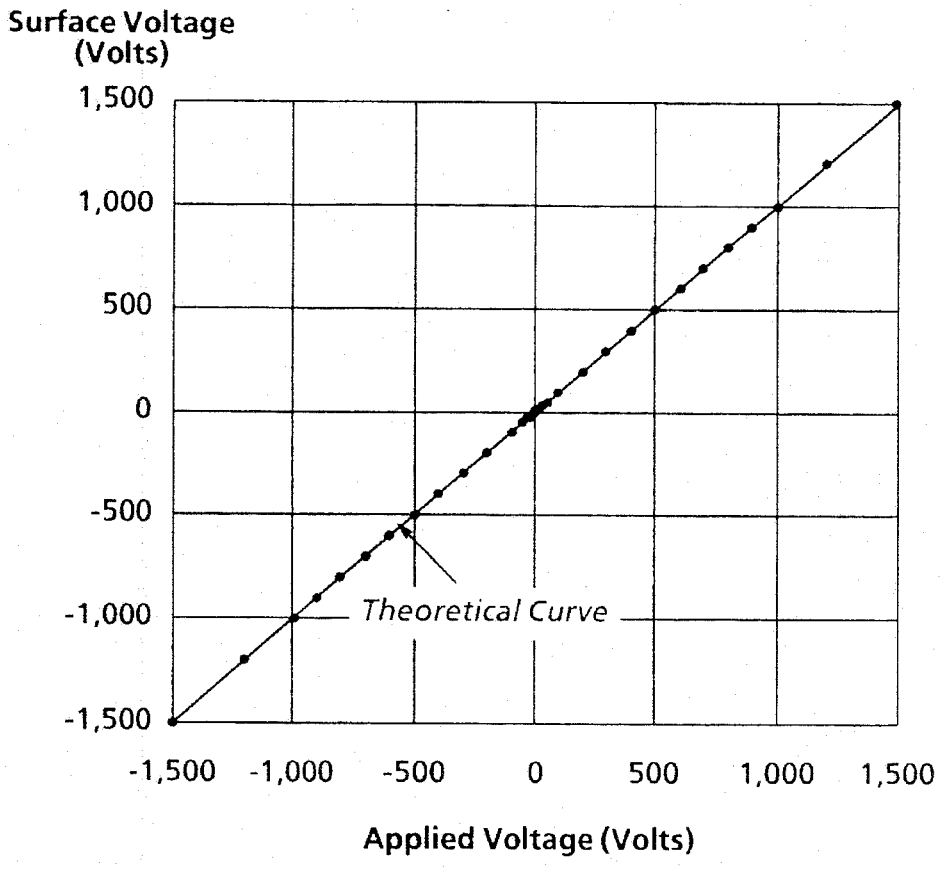

FIG. 2 indicates that the surface voltage developed on an insulative substrate or imaging member is very closely equal to the voltage applied to the liquid. Preferred is when the surface voltage equals the applied voltage. In FIG. 2, the liquid is water and the insulative substrate is aluminized MYLAR®. The threshold voltages for the onset of charging are extremely low, approximately 1 to 2 volts. In contrast, the threshold voltage for the onset of corotron charging is typically around 400 volts.

A second advantageous characteristic of ion transfer charging is the high current efficiency of its operation.

Figure 3:
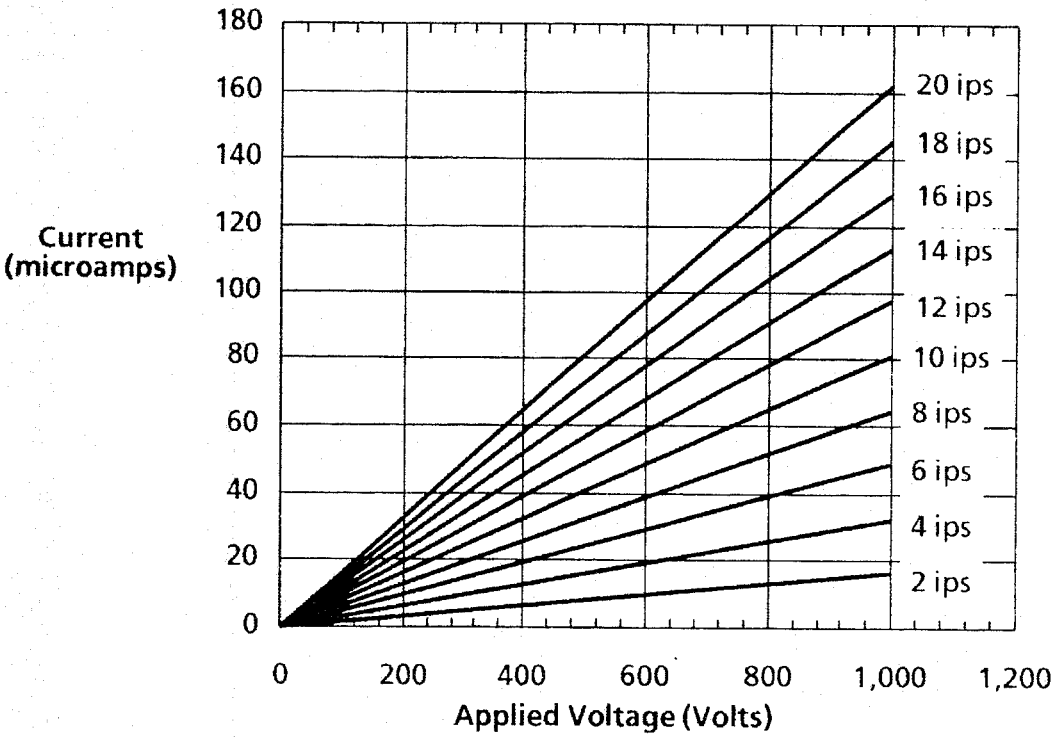

FIG. 3 shows the theoretically calculated currents for the charging of a 12 inch wide insulative substrate of a dielectric constant 3.0 and thickness of 0.001 inch as a function of applied voltage, from 0 volts to 1,000 volts, and process speed, from 2 inches per second to 20 inches per second. The magnitude of the current consumed by a scorotron for charging in, for example, a Xerox Corporation Model 5012 copier to 750 volts at 2 inches per second is 250 microamperes. In comparison, FIG. 3 indicates that the current consumed by the process of ion transfer charging under the same conditions is about 12 microamperes. Thus, ion transfer charging consumes about 20 times less current than the scorotron. Moreover, the scorotron requires a power supply capable of delivering the 6 kV needed to generate the corona, while ion transfer charging requires only about 750 volts, an approximate factor of 10 reduction in power supply requirements.

The erase lamp can be eliminated because the ionically conductive medium is able to charge imaging members to any voltage including zero (0) volts. Thus, it is possible to ground the ionically conductive liquid and withdraw the residual charge remaining on the imaging member back into the ionic medium. Therefore, an erase lamp is not needed to photodischarge the residual charge. Moreover, it is not even necessary to erase the charge on the imaging member because the imaging member cannot be overcharged. All that is needed is to recharge the imaging member to its initial voltage. Since ion transfer charging charges with extremely high uniformity, those areas of the imaging member surface which are deficient in charge, as a result of imagewise exposure, will be brought up to the voltage applied to the liquid.

The conductive charging fluid can be contacted by the layered photoreceptor by a number of different methods. The fluid itself may be directly contacted with the photoreceptor surface by allowing it to impinge upon the surface through a slot in the container reservoir. The fluid is sealed from leaking out of the reservoir by an elastomeric gasket or shoe. The durometer of the elastomer is selected so as to allow it to conform to the asperities in the photoreceptor surface and to any curvature in the photoreceptor, such as a drum. Any droplets which may transfer to the surface can be wiped away by a wiper blade, for example. Electrical contact can be made to the developer either by immersing a wire therein or by applying a voltage directly to the fluid container, when it is comprised of a conductive material.

The developer can also be contacted to the surface by imbibing an absorbant charging blade with the fluid, and the blade is contacted with the surface of the imaging member in the wiping mode. The blade can be comprised of an absorbant felted material, or an open cell foam, for example. The charging blade is mounted onto a support and is continually moistened from a reservoir containing the ionically conductive fluid. A wiper blade can be located downstream in the process direction of the ionically conductive blade, insuring that droplets of ionically conductive fluid do not transfer to the surface of the imaging member. Electrical contact to the fluid wetted felt or foam blade can be made by placing a metal contact or wire against it. The voltage is then applied to this contact. Alternatively, the voltage may be applied to the support material when it is comprised of an electrically conductive material.

An additional method for implementing the developer contact with the charging device involves a metering roll. The developer is contained in a reservoir and is applied to the metering roll by a wick so that the metering roll is wetted by a thin layer of the developer, the layer thickness being a few microns, for example from about 1 to about 3 microns in embodiments. The metering roll can instead be in direct contact with the developer and should be compliant to make good contact with the surface of the imaging member. The metering roll surface should be hydrophilic and can be comprised of an electrically conductive or electrically insulating material.

A stiff shaft serves as the core onto which is coated an elastomeric polymer like polyurethane which provides compliancy for the roller. A polyurethane foam can be used as well to provide a compliant base. The elastomeric layer is then coated with a thin smooth impermeable polymeric layer, preferably 0.5 mil to 5 mil thick, which need not be ionically conductive. This layer should be wettable, preferably hydrophilic, by the developer.

Alternatively, the elastomeric layer can be a hydrophobic polymer, for example VITON®, a copolymer of vinylidene fluoride/hexafluoropropylene, or terpolymers of vinylidene fluoride/hexafluoropropylene and tetrafluoroethylene. Its surface can be chemically treated so as to make it hydrophilic. For example, it may be treated by exposure to ozone gas, or other oxidizing agents such as chromic acid. Yet another way of making a surface, such as VITON®, hydrophilic is to roughen it, for example, by sanding it with fine sand paper.

One advantage of the process of the present invention relative to a corotron is that ozone production is significantly reduced when charging layered imaging members. Contact developer charging produces less than 10 percent of the ozone that a corotron produces. At voltages between −800 volts and 800 volts, a corona is not visually observable in a completely darkened room with the process of the present invention. Also, the odor of ozone is not detectable with the process of the present invention. Chemical measurements indicate a concentration of less than 0.05 ppm ozone production. Since organic photoreceptors are usually charged to less than −800 volts, the developer charging of the present invention is for all practical purposes ozoneless. This eliminates one photoreceptor degradation mechanism, that is a print defect commonly known as parking deletions. In addition, the need for ozone management and filtration is mitigated. Thus, the developer charging processes of the present invention present a lower health hazard than a corotron or scorotron.

Numerous different photoreceptors, and preferably layered photoresponsive imaging members can be charged with the processes of the present invention. In embodiments, thus the layered photoresponsive imaging members to be charged are comprised of a supporting substrate, a charge transport layer, especially an aryl amine hole transport layer, and situated therebetween a photogenerator layer comprised, for example, of titanyl phthalocyanine of Type IV, Type I, or Type X, with Type IV being preferred. A positively charged layered photoresponsive imaging member that may be selected for charging can be comprised of a supporting substrate, a charge transport layer, especially an aryl amine hole transport layer, and as a top overcoating a photogenerating pigment layer with optional layers, such as adhesive layers, therebetween.

The photoresponsive imaging members can be prepared by a number of known methods, the process parameters and the order of coating of the layers being dependent on the member desired. The imaging members suitable for positive charging can be prepared by reversing the order of deposition of photogenerator and hole transport layers. The photogenerating and charge transport layers of the imaging members can be coated as solutions or dispersions onto selective substrates by the use of a spray coater, dip coater, extrusion coater, roller coater, wire-bar coater, slot coater, doctor blade coater, gravure coater, and the like, and dried at from 40° to about 200° C. for from 10 minutes to several hours under stationary conditions or in an airflow. The coating is accomplished to provide a final coating thickness of from 0.01 to about 30 microns after it has dried. The fabrication conditions for a given layer can be tailored to achieve optimum performance and cost in the final device.

A negatively charged photoresponsive imaging member to be charged can be comprised in the order indicated of a supporting substrate, a solution coated adhesive layer comprised, for example, of a polyester 49,000 resin available from Goodyear Chemical, a photogenerator layer comprised, for example, of metal phthalocyanines, metal free phthalocyanines, perylenes, titanyl phthalocyanines, vanadyl phthalocyanines, selenium, trigonal selenium, and the like, optionally dispersed in a resin binder, and a hole transport layer comprised of, for example, an aryldiamine like N,N'-diphenyl-N,N'-bis(3-methyl phenyl)-1,1'-biphenyl- 4,4'-diamine, dispersed in a polycarbonate resinous binder.

A positively charged photoresponsive imaging member to be charged is comprised of a substrate, a charge transport layer comprised of N,N'-diphenyl-N,N'-bis(3-methylphenyl)- 1,1'-biphenyl-4,4'-diamine dispersed in a polycarbonate resinous binder, and a photogenerator layer optionally dispersed in an inactive resinous binder.

Substrate layers selected for the imaging members can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In embodiments, the thickness of this layer is from about 75 microns to about 300 microns.

Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the photogenerator pigment composition is present in an amount of from about 5 percent to about 100 percent by volume. In embodiments, this layer is of a thickness of from about 0.25 micron to about 1 micron when the photogenerator composition is present in this layer in an amount of 30 to 75 percent by volume. The maximum thickness of this layer in an embodiment is dependent primarily upon factors, such as photosensitivity, electrical properties and mechanical considerations. The charge generator layer can be obtained by dispersion coating the photogenerating pigment and a binder resin with a suitable solvent. The binder may be omitted. The dispersion can be prepared by mixing and/or milling the pigment in equipment such as paint shakers, ball mills, sand mills and attritors. Common grinding media, such as glass beads, steel balls or ceramic beads, may be used in this equipment. The binder resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. The solvents to dissolve these binders depend upon the particular resin. In embodiments of the present invention, it is desirable to select solvents that do not effect the other coated layers of the device. Examples of solvents useful for coating the photogenerating pigment dispersions to form a photogenerator layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate, methoxyethyl acetate, and the like.

The coating of the photogenerating pigment dispersion in embodiments of the present invention can be accomplished with spray, dip or wire bar methods such that the final dry thickness of the charge generator layer is from 0.01 to 30 microns and preferably from 0.1 to 15 microns after being dried at 40° to 150° C. for 5 to 90 minutes.

Illustrative examples of polymeric binder resinous materials that can be selected for the photogenerator pigment include those polymers as disclosed in U.S. Pat. No. 3,121,006, the disclosure of which is totally incorporated herein by reference.

As adhesives usually in contact with the supporting substrate, there can be selected various known substances inclusive of polyesters, polyamides, poly(vinyl butyral), poly(vinyl alcohol), polyurethane and polyacrylonitrile. This layer is of a thickness of from about 0.05 micron to 1 micron. Optionally, this layer may contain conductive and nonconductive particles, such as zinc oxide, titanium dioxide, silicon nitride, carbon black, and the like, to provide, for example, in embodiments of the present invention desirable electrical and optical properties.

Aryl amines selected for the hole transporting layer, which generally are of a thickness of from about 5 microns to about 75 microns, and preferably of a thickness of from about 10 microns to about 40 microns, include molecules of the following formula

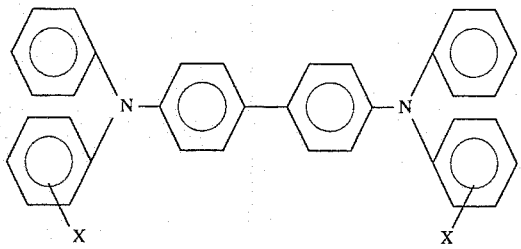

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)- 1,1-biphenyl-4,4'-diamine wherein alkyl is selected from the group consisting of methyl, such as 2-methyl, 3-methyl and 4-methyl, ethyl, propyl, butyl, hexyl, and the like. With chloro substitution, the amine is N,N'-diphenyl-N,N'-bis(halophenyl)-1,1'-biphenyl-4,4'-diamine wherein halo is 2-chloro, 3-chloro or 4-chloro. Other known charge transport layer molecules can be selected, reference for example U.S. Pat. Nos. 4,921,773 and 4,464,450, the disclosures of which are totally incorporated herein by reference.

Examples of the highly insulating and transparent resinous material or inactive binder resinous material for the transport layers include materials, such as those described in U.S. Pat. No. 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the resinous binder contains from about 10 to about 75 percent by weight of the active charge transport material, and preferably from about 35 percent to about 50 percent of this material.

Examples of specific AB diblock copolymer surfactants present in various effective amounts as illustrated herein, include poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co- 2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], poly[2-dimethylammoniumethyl methacrylate tosylate co-N,N-dibutylacrylamide], poly[4-vinyl-N,N-dimethylanilinium bromide co- 2-ethylhexyl methacrylate], poly[4-vinyl-N,N-dimethylanilinium tosylate co- 2-ethylhexyl methacrylate], poly[ethylenimmonium bromide co-2-ethylhexyl methacrylate], poly[propylenimmonium bromide co-2-ethylhexyl methacrylate], poly[N,N-dimethyl-N-ethyl methacrylate ammonium bromide (A block)-co-2-ethylhexyl methacrylate (B block)], poly[N,N-dimethyl-N-ethyl methacrylate ammonium tosylate (A block)-co- 2-ethylhexyl methacrylate (B block)], poly[N,N-dimethyl-N-ethyl methacrylate ammonium chloride (A block)-co-2-ethylhexyl methacrylate (B block)], poly[N,N-dimethyl-N-ethyl methacrylate ammonium bromide (A block)-co-2-ethylhexyl acrylate (B block)], poly[N,N-dimethyl-N-ethyl acrylate ammonium bromide (A block)-co-2-ethylhexyl methacrylate (B block)], poly[N,N-dimethyl-N-ethyl acrylate ammonium bromide (A block)-co- 2-ethylhexyl acrylate (B block], poly[N,N-dimethyl-N-ethyl methacrylate ammonium tosylate (A block)-co-2-ethylhexyl acrylate (B block)], poly[N,N-dimethyl-N-ethyl acrylate ammonium tosylate (A block)-co-2-ethylhexyl acrylate (B block)], poly[N,N-dimethyl-N-ethyl methacrylate ammonium chloride (A block)-co-2-ethylhexyl acrylate (B block)], poly[N,N-dimethyl-N-ethyl acrylate ammonium chloride (A block)-co-2-ethylhexyl acrylate (B block)], poly[N,N-dimethyl-N-ethyl methacrylate ammonium bromide (A block)-co-N,N-dibutyl methacrylamide (B block)], poly[N,N-dimethyl-N-ethyl methacrylate ammonium tosylate (A block)-co-N,N-dibutyl methacrylamide (B block)], poly[N,N-dimethyl-N-ethyl methacrylate ammonium bromide (A block)-co-N,N-dibutylacrylamide (B block)], poly[N,N-dimethyl-N-ethyl methacrylate ammonium tosylate (A block)-co-N,N-dibutylacrylamide (B block)], poly[4-vinyl-N,N-dimethylanilinium bromide (A block)-co-2-ethylhexyl methacrylate (B block)], poly[4-vinyl-N,N-dimethylanilinium tosylate (A block)-co-2-ethylhexyl methacrylate (B block)], poly[ethylenimmonium bromide (A block)-co-2-ethylhexyl methacrylate (B block)], and poly[propylenimmonium bromide (A block)-co- 2-ethylhexyl methacrylate (B block)].

Examples of the second surfactants present in various effective amounts as illustrated in the copending patent applications and patents mentioned herein, include aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains 1 to about 6 carbon atoms; bis[tetraalkylated hydroxy naphthoic acid] aluminate wherein alkyl preferably contains 1 to about 6 carbon atoms; and the like. The aforementioned additives can be prepared as illustrated in U.S. Pat. No. 5,223,368, the disclosure of which is totally incorporated herein by reference.

The liquid developer can include other known components, such as pigments like carbon black, cyan, magenta, yellow, and mixtures thereof. The pigment may be present in various effective amounts, such as from about 1 to about 20 weight percent of developer solids of resin, and pigment. Thermoplastic resins selected for the liquid developer are known, and more specifically, are as illustrated in the U.S. patents and copending applications recited herein, such as U.S. Pat. No. 5,366,840, the disclosure of which is totally incorporated herein by reference.

Examples of liquid carriers selected for the developers of the present invention include a nonpolar liquid with an effective viscosity as measured, for example, by a number of known methods, such as capillary viscosimeters, coaxial cylindrical rheometers, cone and plate rheometers, and the like, of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon as illustrated herein. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected should have an electrical volume resistivity in excess of $10^9$ ohmcentimeters and a dielectric constant below 3.0. Moreover, the vapor pressure at 25° C. should be less than 10 Torr in embodiments.

While the ISOPAR® series liquids are the preferred nonpolar liquids for use as dispersants in the liquid developers of the present invention, the essential characteristics of viscosity and resistivity may be satisfied with other suitable liquids. Specifically, organic nonpolar hydrocarbon including the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 75 percent to about 99.9 percent, and preferably from about 95 to about 99 percent by weight of the total developer dispersion. The total solids content of the developer is, for example, 0.1 to 10 percent by weight, preferably 0.3 to 3 percent, and more preferably, 0.5 to 2.0 percent by weight.

In embodiments thereof, the present invention is directed to the use of liquid developers containing a mixture of surfactants, and wherein the fluid conductivity of the liquid developer is increased compared to a liquid without a surfactant mixture, for example an 80/20 weight percent mixture of HBr Quat salt/ALOHAS surfactants has a conductivity of about 100 times greater than the same concentration of the individual component of HBr salt or ALOHAS.

The following Examples are being provided to further define various species of the present invention, and these Examples are intended to illustrate and not limit the scope of the present invention. Parts and percentages are by weight unless otherwise indicated.

EXAMPLE I

A test substrate comprised of a piece of aluminized MYLAR® 19 inches in length and 2.5 inches in width was wrapped and taped onto a 6 inch diameter aluminum drum with the aluminum side down, i.e., contacting the aluminum drum. The drum was capable of being driven at variable circumferential speeds of from 0 to 15 inches per second.

A charging device was set up as follows. A commercially available polyurethane cleaning blade was affixed into a brass holder. The dimensions of the blade were about 1 millimeter in thickness and 1.7 inches in width. The position brass holder was adjustable and capable of mounting the polyurethane blade in the wipe configuration with variable pressure and at various angles with respect to the aluminum drum. The polyurethane blade was modified on the entrance nip with electrically conductive copper tape. The high voltage power supply was connected to the copper tape with an alligator clip while the ground side of the power supply was connected to the MYLAR® ground plane via the aluminum drum.

A liquid charging fluid comprised of 0.1 weight percent of polymeric HBr Quat poly[N,N-dimethyl-N-ethyl methacrylate ammonium bromide (A block)-co-2-ethylhexyl methacrylate (B block)] of a molecular weight of 4,000 dissolved in NORPAR 15® was used as the ionically conductive liquid fluid. The conductivity of this fluid was 17.2 picomho/cm. Approximately 100 microliters of the fluid was placed on the entrance nip side of the polyurethane blade thereby enabling contact with both the MYLAR® surface and the copper tape. Sufficient fluid was placed on the entrance nip so that a continuous bead was formed across the entire polyurethane blade width.

A DC voltage was then applied to the copper tape and the drum was rotated at a constant circumferential speed. The steady state charging current and voltage were measured and recorded at a process speed of 2 inches per second. Between voltage measurements the charge on the surface was grounded. The results for charging with the above polymeric HBr Quat fluid are shown as the filled circle data points in FIG. 4.

Figure 4:
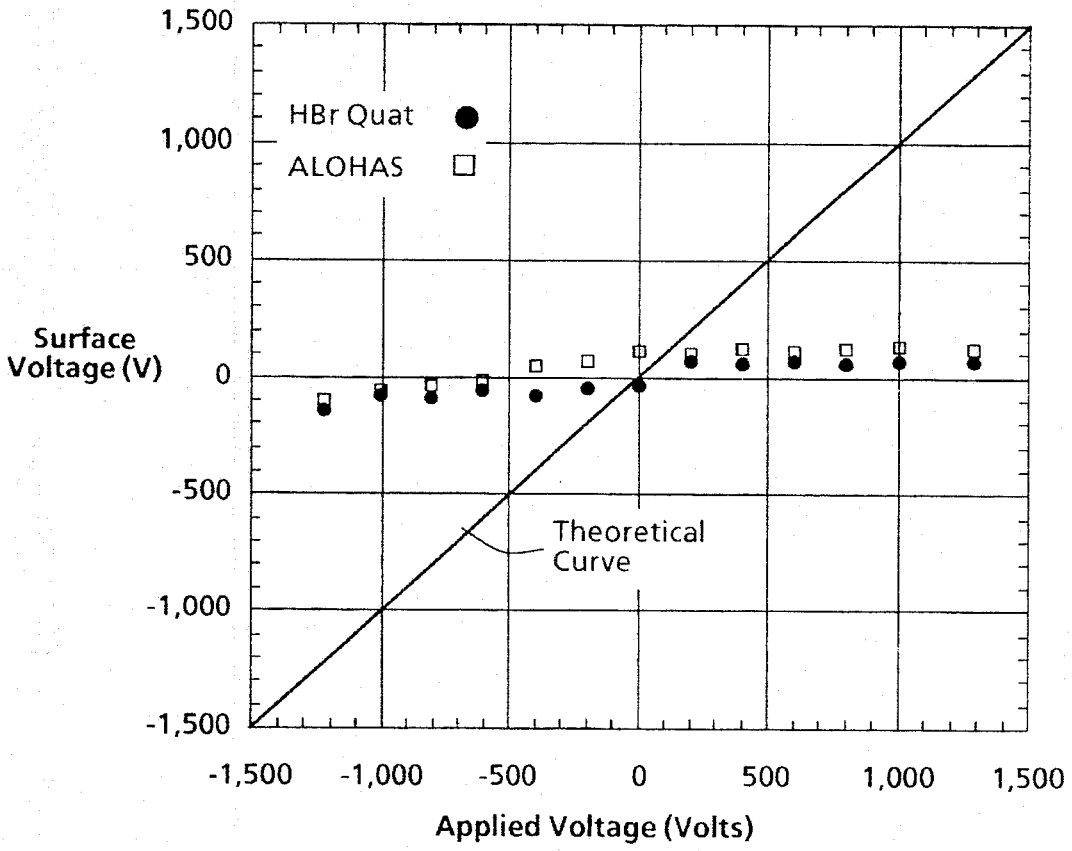

A second fluid comprised of 0.1 weight percent ALOHAS (hydroxy bis[3,5-di-t-butyl salicylic] aluminate monohydrate) dissolved in NORPAR 15® was evaluated in a similar manner and the results are presented as the open squares in FIG. 4. The conductivity of the ALOHAS fluid was 10.7 pmho/centimeter (picomho/cm). The charging characteristics of both the HBr Quat fluid and the ALOHAS fluid were far from the line which described the theoretical charging characteristics of ion transfer charging. These low conductivity fluids did not perform as adequately as ionically conductive liquids for ion transfer charging because it is believed that most of the applied voltage was dropped in the liquid itself. In addition to the difficulty in charging the surface, both fluids exhibited an inadequate ability to remove charge from the surface.

Finally, a third fluid was prepared from a mixture of the surfactants. The solution was comprised of 0.08 weight percent of the above HBr Quat surfactant and 0.02 weight percent of the above ALOHAS surfactant. The total concentration of solids was 0.10 weight percent, similar to both the HBr Quat and ALOHAS fluids in the experiments described above. However, the mixture of surfactants now yielded an ionic conductivity of about 700 pmho/centimeter, approximately two orders of magnitude greater than the ionic conductivity of the individual component surfactant solutions. This particular ratio of 4 parts of HBr Quat to 1 part of ALOHAS corresponded to the composition of maximum ionic conductivity. The charging performance of the mixture of the surfactants was, therefore, dramatically improved as shown in FIG. 5.

Figure 5:
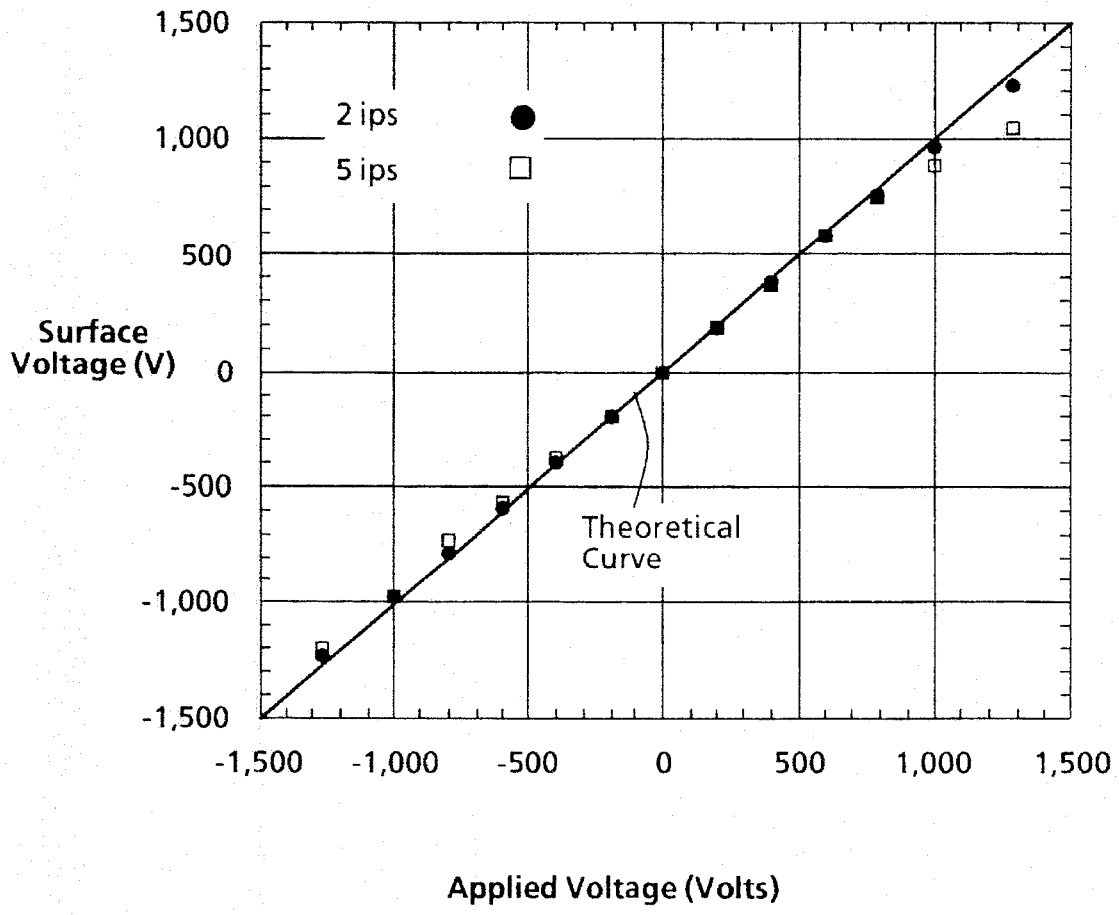

FIG. 5 shows a plot of surface voltage against the applied voltage at process speeds of 2 inches per second (filled circles) and 5 inches per second (open squares). The charging curve for ideal ion transfer charging is given by the solid line. Thus, charging at 2 inches per second and 5 inches per second follows very closely the ideal charging curve. The performance is almost indistinguishable from the theoretical charging curve. (The total solids in FIG. 4 and FIG. 5 are identical). Thus, the mixture of surfactants can provide a method to achieve both improved conductivity and greatly improved charging capability. In addition, it is possible to decrease the total solids content and still achieve adequate charging characteristics.

Other modifications of the present invention may occur to those of ordinary skill in the art subsequent to a review of the present application and these modifications, including equivalents thereof, are intended to be included within the scope of the present invention.

What is claimed is:

1. A process for charging layered imaging members by the transfer of ions thereto which comprises contacting the imaging member with a liquid composition comprised of a nonpolar liquid, and a mixture of surfactants of an ammonium block copolymer first surfactant of the formula

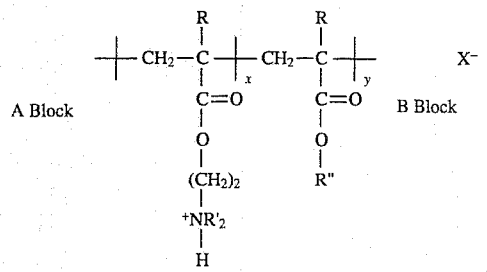

wherein $X^-$ is a conjugate base or anion of a strong acid; R is hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 1,000 to 200; and a second surfactant component of the formula

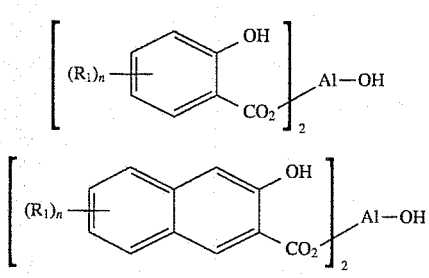

wherein $R_1$ is selected from the group consisting of hydrogen and alkyl, and n is 0 (zero), 1,2, 3, or 4 and applying a voltage to said liquid composition.

2. A process in accordance with claim 1 wherein the block copolymer first surfactant is a diblock copolymer selected from the group consisting of poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

3. A process in accordance with claim 1 wherein the liquid composition contains thermoplastic resin, and pigment.

4. A process in accordance with claim 3 wherein the pigment is black, cyan, magenta, yellow, or mixtures thereof.

5. A process in accordance with claim 1 wherein the composition further contains a charge adjuvant selected from the group consisting of polyhydroxy compounds which contain at least 2 hydroxy groups, amino alcohol, polybutylene succinimide and metallic soaps.

6. A process in accordance with claim 1 wherein the liquid is an aliphatic hydrocarbon.

7. A process in accordance with claim 6 wherein the aliphatic hydrocarbon is a mixture of branched hydrocarbons of from about 12 to about 20 carbons atoms.

8. A process in accordance with claim 6 wherein the aliphatic hydrocarbon is a mixture of normal hydrocarbons of from about 10 to about 20 carbon atoms.

9. A process in accordance with claim 6 wherein the aliphatic hydrocarbon is a mixture of normal hydrocarbons of from about 10 to about 16 carbon atoms.

10. A process in accordance with claim 1 wherein R' is hydrogen, methyl, ethyl, propyl, or butyl.

11. A process in accordance with claim 1 wherein R' is alkyl, and R" is alkyl.

12. A process in accordance with claim 1 wherein the second surfactant is a hydroxy aluminum complex of the formula as represented by

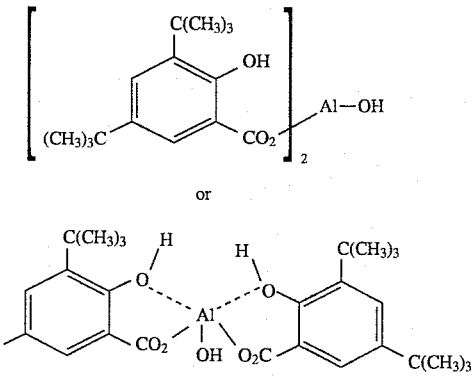

13. A process in accordance with claim 1 wherein the second surfactant is selected from the group consisting of hydroxy bis[3,5-di-tert-butyl salicylic] aluminate, hydroxy bis[3,5-di-tert-butyl salicylic] aluminate monohydrate, hydroxy bis[3,5-di-tert-butyl salicylic] aluminate dihydrate, hydroxy bis[3,5-di-tert-butyl salicylic] aluminate tritetrahydrate, and mixtures thereof.

14. A process in accordance with claim 1 wherein the first surfactant is present in an amount of from about 5 to about 95 weight percent, and the second surfactant is present in an amount of from about 95 to about 5 weight percent.

15. A process in accordance with claim 1 wherein the first surfactant is present in an amount of about 80 weight percent, and the second surfactant is present in an amount of about 20 weight percent.

16. A process in accordance with claim 1 wherein ion charges of a negative polarity, or ion charges of a positive polarity are transferred.

17. A process in accordance with claim 1 wherein said members are comprised of organic photoconductive imaging members.

18. A process in accordance with claim 17 wherein the organic photoconductive imaging members are comprised of a supporting substrate, a photogenerating layer and a charge transport layer.

19. A process in accordance with claim 1 wherein an inorganic photoconductive imaging member is selected and is selenium, or the alloys thereof, or hydrogenated amorphous silicon; and ozone emission is avoided.

20. A process in accordance with claim 1 wherein the imaging members are moved while in contact with the liquid developer.

21. A process in accordance with claim 20 wherein movement is by rotation of said imaging members.

22. An ozone free process for the ion transfer charging of photoconductive imaging members which comprises contacting a liquid composition comprised of a nonpolar liquid, and a mixture of surfactants of an ammonium block colpolymer first surfactant of the formula

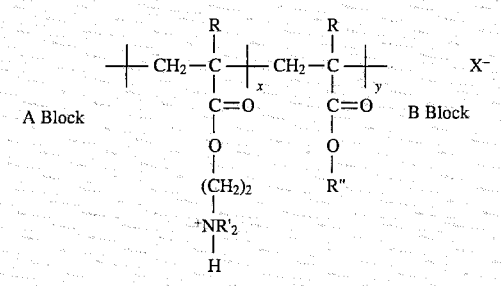

wherein $X^-$ is a conjugate base or anion of a strong acid; R hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 1,000 to 200; and a second surfactant component of the formula

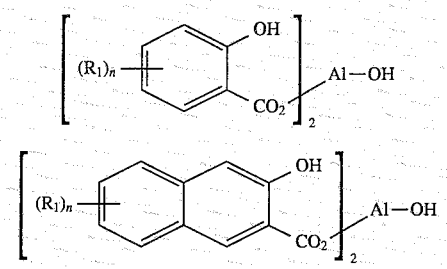

wherein $R_1$ is selected from the group consisting of hydrogen and alkyl, and n is 0 (zero), 1, 2, 3, or 4 with the surface of a photoconductive imaging member, and applying a voltage to the liquid composition while moving the imaging member thereby enabling the transfer of ions to said member.

23. A process in accordance with claim 22 wherein movement is by rotation at high speeds of from about 0.1 inch to about 50 inches per second of said imaging members.

24. A process in accordance with claim 22 wherein the voltage applied is from about ±1 volts to about ±5,000 volts.

25. A process in accordance with claim 22 wherein the voltage applied is from about ±50 volts to about ±1,000 volts, and preferably from about ±300 volts to about ±750 volts.

26. A process in accordance with claim 1 wherein the contacting is for a period of time of from about 1 millisecond to about 15 seconds.

27. A process in accordance with claim 1 wherein the contacting is for a period of time of from about 5 milliseconds to about 1 second.

28. A process in accordance with claim 1 wherein the liquid developer is delivered to the imaging member by a sponge, an open cell foam, a roll, a blade and/or a wick.

29. A process in accordance with claim 1 wherein the diblock B:A molar ratio is from about 0.1:99.9 to about 99.9:0.1.

30. A process in accordance with claim 1 wherein charging of an ionographic receiver is accomplished.

31. A process in accordance with claim 1 wherein the first surfactant is ABA, or BAB copolymers.

* * * * *